US005582571A

United States Patent [19]

Simpson et al.

[11] Patent Number: 5,582,571

[45] Date of Patent: Dec. 10, 1996

[54] APPARATUS AND METHOD FOR PERFORATING AND CREASING PAPERBOARD

[75] Inventors: Jack R. Simpson, Raleigh; Jeffrey A. Geer, Apex, both of N.C.

[73] Assignee: Container Graphics Corporation, Cary, N.C.

[21] Appl. No.: 180,860

[22] Filed: Jan. 13, 1994

Related U.S. Application Data

[63] Continuation-in-part of Ser. No. 863,446, Apr. 3, 1992, abandoned.

[51] Int. Cl.[6] ..... B65H 35/08; B65H 45/28

[52] U.S. Cl. ..... 493/355; 493/399; 493/402; 83/862; 83/884; 83/886

[58] Field of Search ..... 493/354, 355, 493/367, 370, 372, 399, 402, 403; 83/620, 660, 695, 862, 883, 884, 886, 887

[56] References Cited

U.S. PATENT DOCUMENTS

| | | | |
|---|---|---|---|
| 371,736 | 10/1887 | Burton | 493/355 |
| 1,473,089 | 11/1923 | Faust . | |
| 2,830,506 | 4/1958 | Burroughs . | |
| 3,119,312 | 1/1964 | Henc . | |
| 3,255,949 | 6/1966 | Buttery | 83/862 |
| 3,280,682 | 10/1966 | Sauer . | |
| 3,386,323 | 6/1968 | Dovey . | |
| 3,393,969 | 5/1968 | Saunders . | |
| 3,395,598 | 8/1968 | Martin . | |
| 3,795,164 | 3/1974 | Schneider . | |
| 4,020,724 | 5/1977 | Quinlan . | |
| 4,596,541 | 6/1986 | Ward, Sr. | 493/59 |
| 4,852,442 | 8/1989 | Pottorff | 83/620 |
| 5,001,956 | 3/1991 | Nitsch . | |
| 5,429,577 | 7/1995 | Simpson et al. | 493/354 |

*Primary Examiner*—Jack W. Lavinder

*Attorney, Agent, or Firm*—Bell, Seltzer, Park & Gibson, P.A.

[57] ABSTRACT

The present invention provides an apparatus and method for perforating and creasing a paperboard sheet utilizing a rotary die process. The method and apparatus employ a die rule that comprises a base adapted to be attached to a die roll of a rotary die machine, a plurality of tooth elements, and open spaces between at least some of the plurality of tooth elements. Each of the plurality of tooth elements comprises a body portion that is fixed to and extends radially outwardly from the die roll and a laterally-tapered tooth portion. Each open space is defined by lateral portions of adjacent teeth element body portions and by the base outer edge. The body portion preferably extends radially outwardly from the base so that substantially all of the tooth portion penetrates the outer surface of the paperboard, and the base outer edge extends outwardly so that it engages and creases the inner surface of the paperboard. It is also preferred that the lateral portions of the tooth element body portions are substantially perpendicular to adjacent open spaces so that perforations formed on the paperboard inner surface are substantially the same length as those formed in the paperboard outer liner.

17 Claims, 10 Drawing Sheets

APPARATUS AND METHOD FOR PERFORATING AND CREASING PAPERBOARD

RELATED APPLICATIONS

This application is a continuation-in-part of pending U.S. patent application Ser. No. 07/863,446, filed Apr. 3, 1992 for MULTIPURPOSE ROTARY SLIT SCORER AND PRODUCTS FORMED THEREBY, now abandoned the disclosure of which is incorporated herein by reference in its entirety.

FIELD OF THE INVENTION

The present invention relates generally to forming paperboard, and more particularly relates to forming perforations and creases in paperboard.

BACKGROUND OF THE INVENTION

Paperboard sheets such as are used in the manufacture of cartons, boxes and other die cut products may be cut, trimmed, creased, perforated and/or otherwise "shaped" in a number of different ways. This may be done manually; by reciprocating flat dies; by sequentially subjecting each panel to the action of a plurality of discrete machines which respectively perform different ones of the desired cutting, slitting, perforating or other operations needed for desired shaping of the panel; or by use of a rotary die apparatus. When the number of sheets is sufficiently large, they can be most efficiently shaped by a rotary die apparatus. This is due to the high speed at which a rotary die apparatus operates, and also to its ability to substantially simultaneously perform a plurality of different shaping operations upon a sheet during single passage of it through the nip between cooperating die and anvil rolls of the apparatus. However, the prior art rotary die apparatuses have not heretofore produced tear strips, punch-outs, foldable creases, nicking connectors and similar weakened or "frangible" sections of optimum quality. Additionally, the prior rotary die apparatuses have not been able to form fold lines about which thereto adjacent panels of a paperboard sheet freely can undergo relative reverse pivotal movement, i.e., movement bringing the outer "printed" liners of the panels toward each other.

The metal die rule element customarily employed in a rotary die apparatus for forming tear strips, punch-outs, and similar perforate connectors has a plurality of relatively wide rectangularly shaped and laterally spaced teeth that extend outwardly from the base section of the rule and from the die board of the die roll. Except when the flat outer ends of the teeth have been recently sharpened, they do not easily or consistently penetrate the panels to the desired extent and tend to undesirably cut and/or crack the paperboard. When the frangible section of the panel is a tear strip, punch-out, nicking connector or the like, this makes it difficult or impossible for a person to readily and neatly tear the sheet at the desired frangible location(s). Another undesirable consequence of use of a perforating rule having rectangular teeth is the tendency of the paperboard sheet to adhere to the rule unless positively separated therefrom by product ejection means which may significantly reduce the strength of the sheet.

For certain types of paperboard containers, it is desirable to form the paperboard so that it has on one side serially aligned alternating slits and creases, and on the other side it has serially aligned discontinuous slits. The slits on the inner, or die-side, liner of the paperboard are of the same size and are directly opposite those on the outer ply. This type of pattern, known as perforation-scoring, is used to encourage folding of the paperboard at the line defined by the slits and creases. Typically, the paperboard is folded so that the portions of the inner liner on either side of the slit-crease line move to face one another, although the paperboard can also be folded in the opposite direction. The perforation-scoring pattern is formed by utilizing a die rule with a plurality of rectangular teeth, each of which is separated from adjacent teeth by a creasing edge. This rule has been used successfully with reciprocating flat-die processes in which the penetration depth of the rule can be closely controlled. When rules with rectangular teeth are used in rotary dies, however, the shortcomings described above for rectangular teeth adversely affect the consistency and quality of the slits and creases formed in the paperboard product.

In light of the foregoing, it is an object of the present invention to provide a die rule for perforating and creasing the inner ply of a paperboard and perforating the outer ply of the paperboard that can be used with rotary die processes without cracking or undesirably cutting the paperboard.

It is also an object of the present invention to provide a die rule that perforates and creases as described above that easily penetrates and releases the paperboard.

It is another object of the present invention to provide a method for perforating and creasing a paperboard as described above that uses a rotary die process.

SUMMARY OF THE INVENTION

These and other objects are satisfied by the present invention, which provides an apparatus and method for perforating and creasing a paperboard sheet utilizing a rotary die process. The method and apparatus employ a die rule that comprises a base adapted to be attached to a die roll of a rotary die machine, a plurality of tooth elements, and open spaces between at least some of the plurality of tooth elements. Each of the plurality of tooth elements comprises a body portion that is fixed to and extends radially outwardly from the die roll and a laterally-tapered tooth portion. Each open space is defined by lateral portions of adjacent teeth element body portions and by the base outer edge. The body portion preferably extends radially outwardly from the base so that substantially all of the tooth portion penetrates the outer surface of the paperboard, and the base outer edge extends outwardly so that it engages and creases the inner surface of the paperboard. It is also preferred that the lateral portions of the tooth element body portions are substantially perpendicular to adjacent open spaces so that perforations formed on the paperboard inner surface are substantially the same length as those formed in the paperboard outer liner.

DETAILED DESCRIPTION OF THE INVENTION

Figure 1:
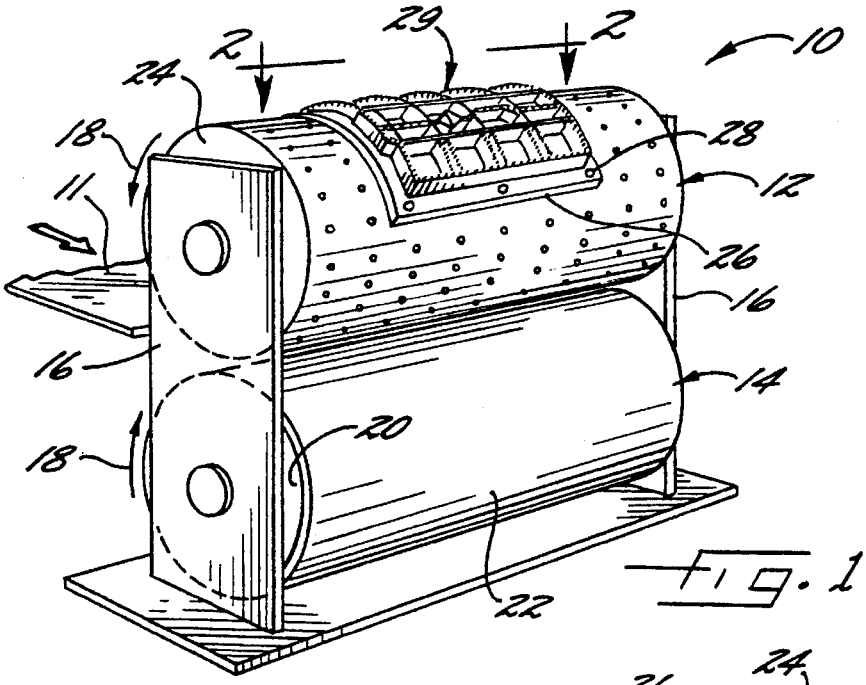
FIG. 1 is a partially schematic perspective view of a rotary die apparatus in accordance with the invention, and of a fragmentarily shown sheet of corrugated paperboard approaching the nip between the die and anvil rolls of the apparatus.

The rotary die apparatus identified in its entirety in FIG. 1 by the numeral 10 includes a die roll 12 and an anvil roll 14 that are mounted by suitable frame means 16 in closely spaced parallel relationship to each other. Rolls 12, 14 are of approximately the same diameter, and are adjustively movable toward and away from each other so as to adjust the height of the nip defined therebetween. During operation of apparatus 10, rolls 12, 14 are driven by suitable drive means (not shown) in opposite angular directions indicated by the arrows 18.

Anvil roll 14 is of a conventional construction, consisting of an inner cylindrical core member 20 having a layer of polyurethane or similar resilient and penetrable material 22 upon its outer surface.

Die roll 12 customarily and illustratively includes a cylindrical inner metallic member 24 and an arcuate die board 26. Die board 26 has a curvature complementary to that of the outer surface of die roll 24 and is releasably secured to the cylindrical outer surface of inner die roll member 24 by threaded fasteners 28 that extend into aligned threaded bores (not shown) of member 24.

Figure 3:
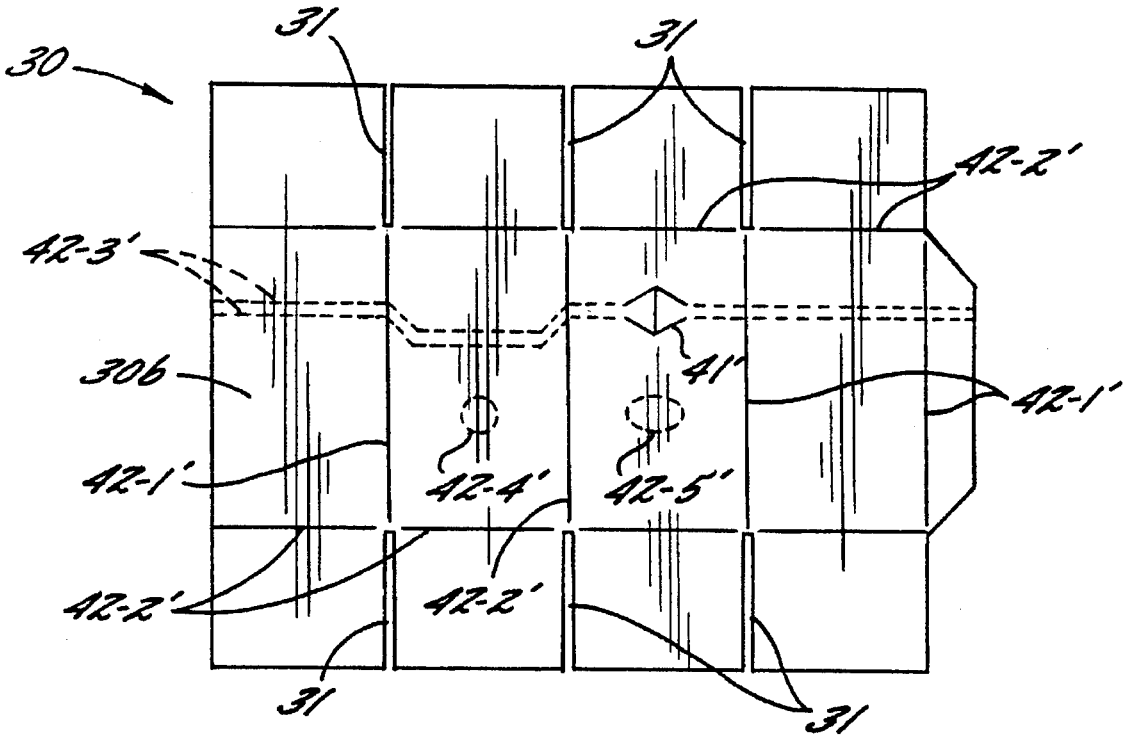
FIG. 3 is a top plan view of an unfolded paperboard box shaped by die members of the rotary die apparatus.

An assembly 29 of metal die rule members is mounted upon and projects outwardly from die board 26. The die rule members of assembly 29 cut, score, slit, perforate and/or otherwise shape corrugated paperboard sheet material 11 passing during operation of apparatus 10 through the nip between rolls 12, 14 so as to produce shaped corrugated paperboard products such as the box blank 30 shown in FIG. 3 and suitable for formation into the paperboard box 30' of FIG. 4. As is best shown in FIG. 6, blank 30 is of a conventional type having inner and outer liner plies **30*a*, 30*b* upon opposite sides of at least one inner corrugated ply 30*c***.

In addition to the die rule members of the above-mentioned type, die board 26 customarily and illustratively also mounts a plurality of product ejection members 32 and scrap ejection members 34. As is well known to those skilled in the art, these assist in ensuring proper release and discharge of paperboard panels 30 and scrap paperboard from die roll 12. The product ejection members 32 and scrap ejection members 34 upon die board 26 are illustratively of the types respectively disclosed in commonly assigned and co-pending U.S. patent application Ser. Nos. 07/692,577 and 07/709,922, and the therein contained disclosures of them are incorporated herein by reference.

The die rule members of assembly 29 (FIG. 2) include a plurality of conventional cutting rules 38, 40 that may be and illustratively are of the type having upon their radially outer edges a plurality of small pointed teeth of triangular shape. In cutting rules of this type, the distance between a plane containing the apexes of the teeth and a parallel plane containing the gullets of the teeth is substantially less than the thickness of a paperboard panel to be cut by the rule. In order to cut completely through the panel, the conventional cutting rule therefore must penetrate into the paperboard sheet to such an extent that the gullet plane of the rule member passes through the outer liner of the paperboard panel. The illustrative cutting rule members shown in FIGS. 1 and 2 include trim breaker rule members 36 that cut scrap trimmed from the leading edge of the paperboard sheet into smaller pieces; peripheral cutting rules 38 that shape the outer periphery of the sheet; slot forming rule members 40 that form slots 31 (FIGS. 3) in the leading and trailing ends of the sheet; a pull tab forming member 41 for forming a pull tab associated with a tear strip forming member; and creasing members 42-1 for forming crease or fold lines 42-1' in the sheet.

Figure 5:
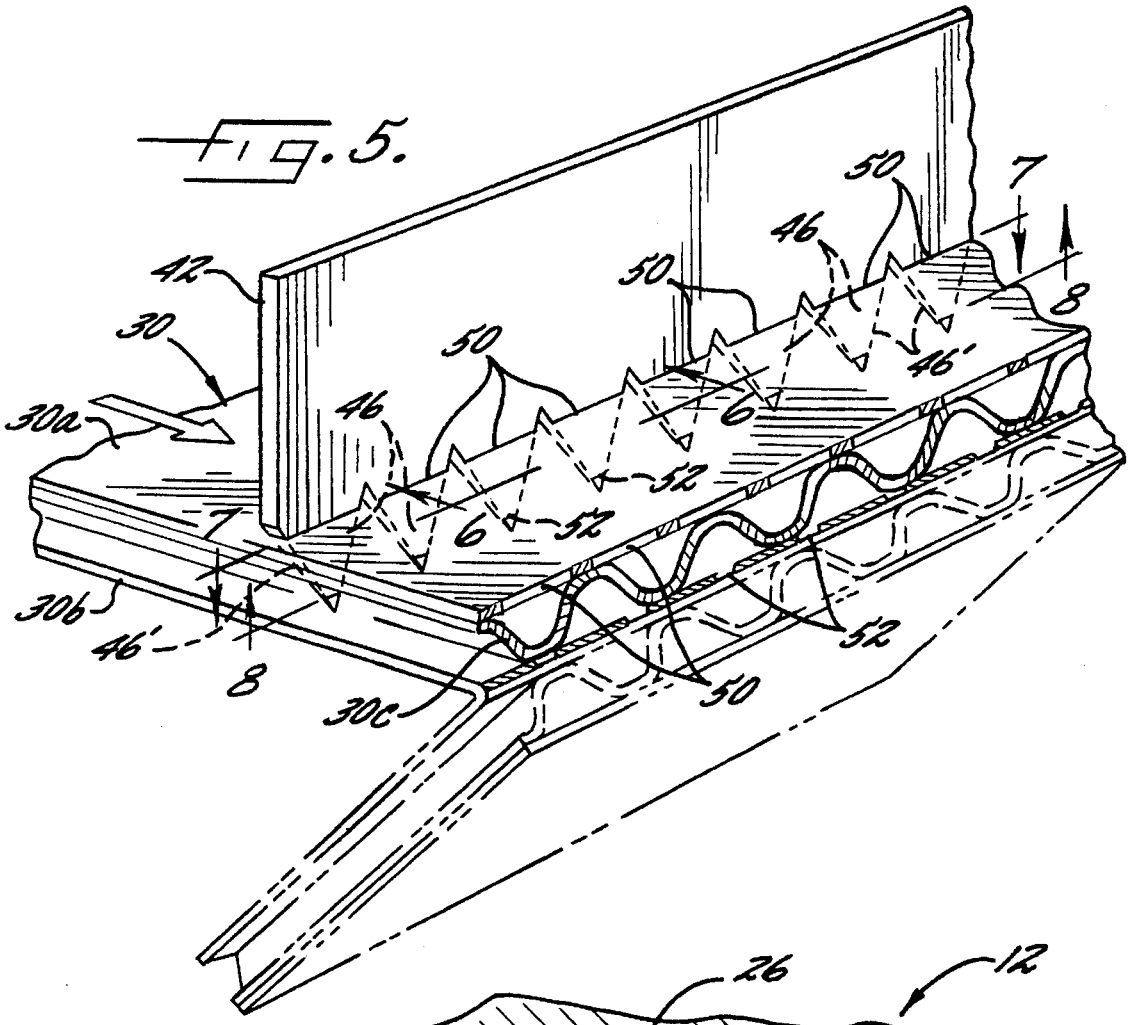
FIG. 5 is a fragmentary perspective view of teeth of a slit scorer die member of the apparatus engaging a paperboard sheet, and also showing in phantom lines a previously slit-scored and backwardly foldable part of the sheet.
Figure 6:
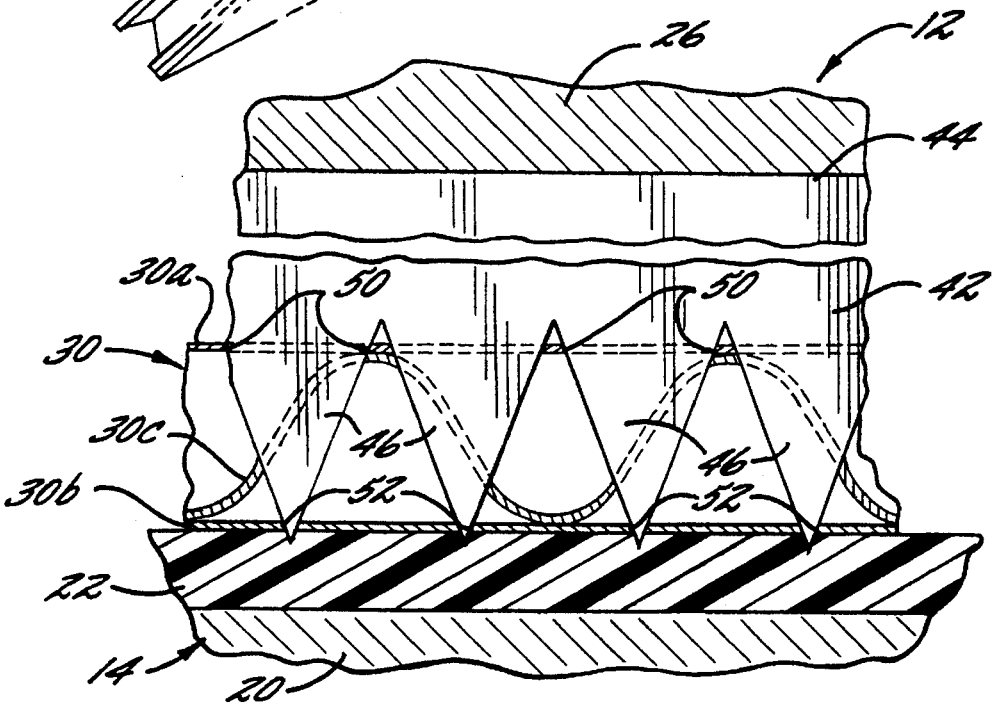
FIG. 6 is an enlarged fragmentary view, partially in elevation and partially in vertical section, taken in the direction of the arrows 6—6 of FIG. 5 and showing fragmentary parts of the die and anvil rolls of the die apparatus.

In accordance with the present invention, the rule members upon die board 26 further include a plurality of slit scorer or perforating rule members 42 of a type fragmentarily shown in FIGS. 5 and 6. Each rule member 42 includes a base section 44 conventionally mounted within a slot of die board 26, and has a plurality of tapered sharp pointed teeth 46, illustratively and preferably of triangular shape, that project outwardly from the base section. Teeth 46 of perforating rule members 42 are much larger than the teeth upon conventional cutting rules. They preferably have a pitch of about 4–6 teeth per inch, and a gullet depth within the range of about 0.100"–0.120". The sharp side edges 46' of each tooth 46 preferably and illustratively define substantially equal angles with a vertical plane transversely bisecting the tooth. In contrast to the rectangularly shaped teeth of the prior art perforating or slit-scoring rules, the tapered teeth 46 of rules 42 readily penetrate into the paperboard stock without significantly crushing it. Additionally, they retain their sharpness for a longer period of time than the rectangularly shaped teeth of the prior art perforating rules, and are less likely to adhere to the paperboard sheet material. Consequently less (and possibly no) ejection rubber is needed to separate the paperboard product from the die roll. This in turn reduces the possibility of the rubber crushing the product and thereby reducing its compression strength.

Figure 7:
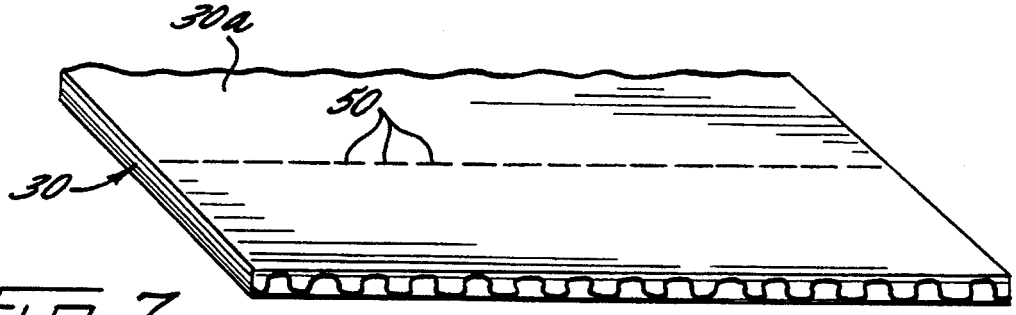
FIG. 7 is a perspective view of slits formed in the inner liner of a paperboard sheet by a toothed perforating rule member of the die apparatus.
Figure 8:
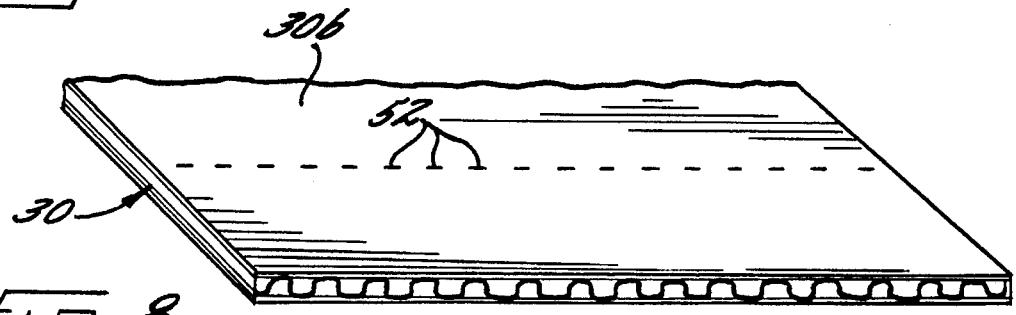
FIG. 8 is a perspective view of slits formed substantially simultaneously in the opposite outer liner of the paperboard sheet of FIG. 7 by the same toothed perforating rule member.

Another difference between the rules 42 and the prior art perforating rules, which form perforations in the paperboard sheet that are the same width throughout the thickness dimension of the sheet, is that the rule members 42 create tapered perforations which decrease in width with increasing distance from the paperboard inner liner 30*a* that is proximate die roll 12. Consequently, and as is best shown in FIG. 5, the perforation formed by each tooth 46 that penetrates completely through panel 30 forms a slit 50 in the inner liner 30*a* of a first length such as that shown by way of illustration and designated by the numeral 50 in FIG. 5; at least one underlying shorter length slit (not shown) in corrugated ply 30*c;* and a still shorter underlying slit 52 within the outer liner ply 30*c* adjacent anvil roll 14. The difference in length of the slits 50, 52 respectively formed in liners 30*a*, 30*b* of the illustrative sheet 30 is also shown in FIGS. 7 and 8. The lengths of the slits 50, 52 are of course illustrative only. If the extent of the penetration of panel 30 by teeth 46 were greater than shown in FIGS. 5 and 6, the lengths of slits 50, 52 would be longer and the slits 50 in inner liner 30*a* might interconnect with each other. Similarly, if the extent of penetration of panel 30 were of lesser magnitude, the slits 50, 52 would be shorter and slits 52 might not extend through face ply 30*b*.

The extent to which teeth 46 penetrate into a paperboard panel is dependent upon the panel thickness, the size of the teeth, the extent to which rule member 42 projects outwardly from die board 26, and/or upon the nip distance between rolls 12, 14 (FIG. 1), and can be adjusted by changing any of the foregoing parameters. Such adjustment in turn permits the formation of panel fold lines, tear strips, punchouts, and other frangible connections having different desired characteristics.

Figure 2:
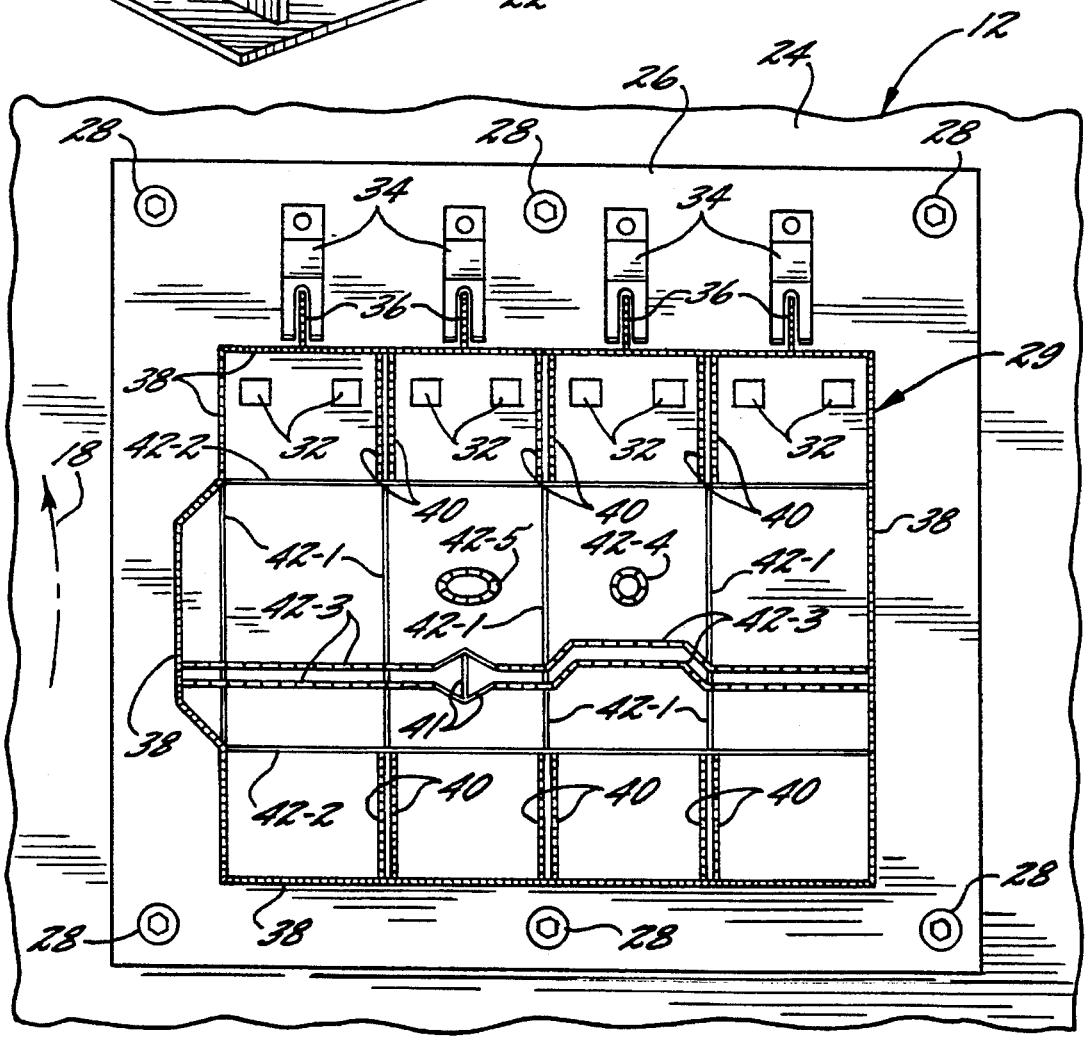
FIG. 2 is a flattened top plan view, looking in the direction of the arrows 2—2 of FIG. 1, of die members upon the die board of the die roll of the apparatus.
Figure 4:
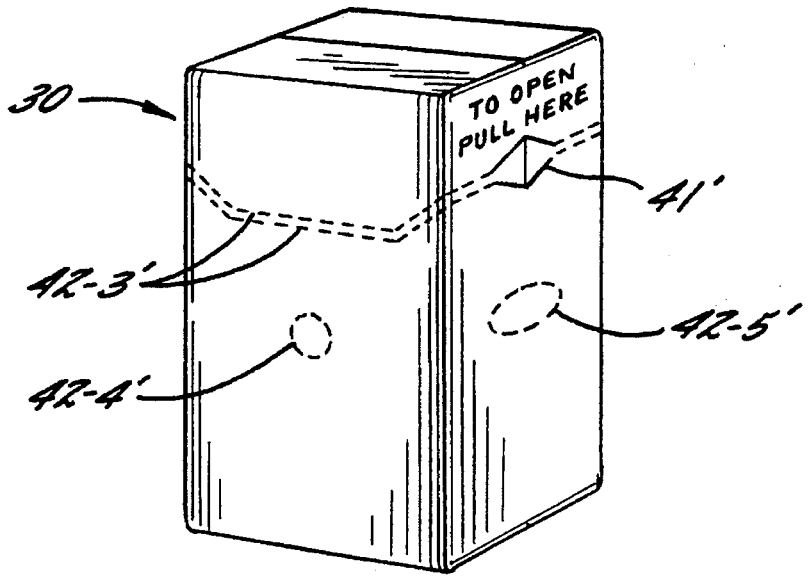
FIG. 4 is a perspective view of the box of FIG. 3 after folding thereof.

The perforating rule members 42 shown by way of illustration in FIG. 2 include ones of different shapes and orientations. The rule members 42-3 have sections that extend perpendicular to the machine direction and other sections that extend in oblique relationship to the machine direction. They could of course also extend parallel to the machine direction. They form tear strip lines 42-3' (FIGS. 3 and 4) in box blank 30. Rule elements 42-4 and 42-5 are of endless circular and oval shape, and respectively form circular and oval punchout lines 42-4' and 42-5' in box blank 30. The lines 42-3', 42-4', and 42-5' are also shown in the FIG. 4 illustration of the folded box formed from the shaped paperboard sheet.

Figure 9:
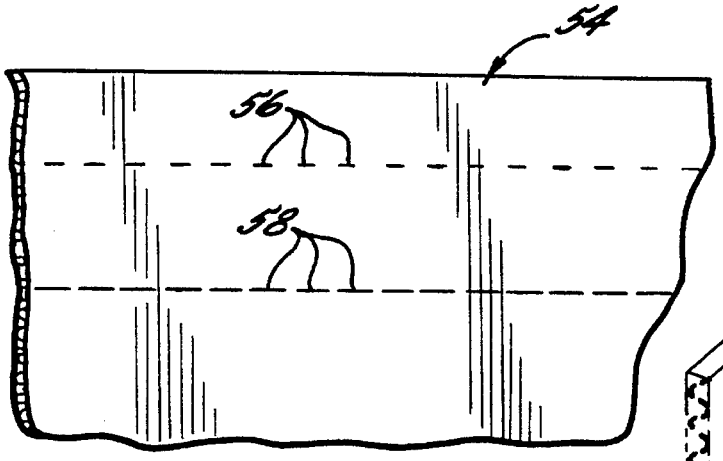
FIG. 9 is a fragmentary plan view of a paperboard sheet having parallel fold lines defined by first and second arrays of slits of first and second different lengths upon the same side of the panel.
Figure 10:
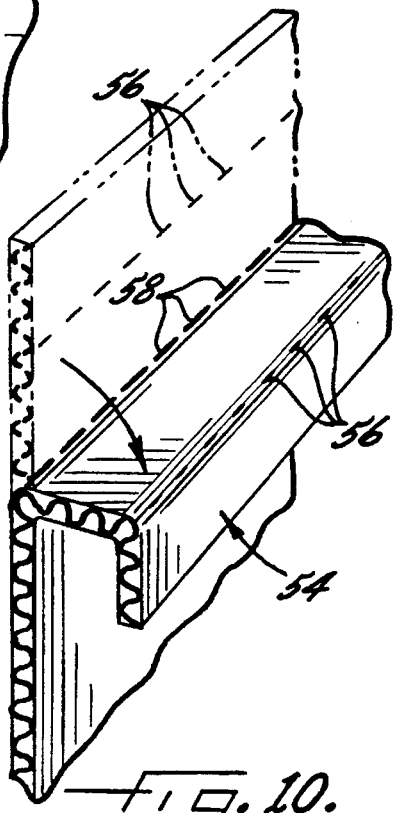
FIG. 10 is a perspective view illustrating sequential folding of the sheet of FIG. 9.

FIGS. 9 and 10 of the drawings show a fragmentary portion of a paperboard sheet 54 having upon the illustrated side thereof substantially parallel fold lines 56, 58 about which sequential folding of the panel is to occur firstly about the fold line 58 and thereafter about fold line 56. In accordance with the present invention, the desired sequential folding of the panel ensues when, as shown, the fold lines are formed by toothed rule members in accordance with the present invention and the rule member used to form fold line 58 produces slits in paperboard panel 54 that are longer and closer together than the slits that define fold line 56. The difference in length of the slits of the two fold lines can be achieved, as described above, by using first and second rule members that have different size teeth, or that project different distances from the outer surface of die roll 24.

The foregoing technique of forming fold lines, in a desired sequence or otherwise, can be employed when the fold lines extend in the machine direction, or perpendicular to the machine direction, or at any intermediate angle. The fold lines may be parallel to the corrugations of the paperboard sheet, or perpendicular to such corrugations, or at any intermediate angle relative to the corrugations.

Figure 11:
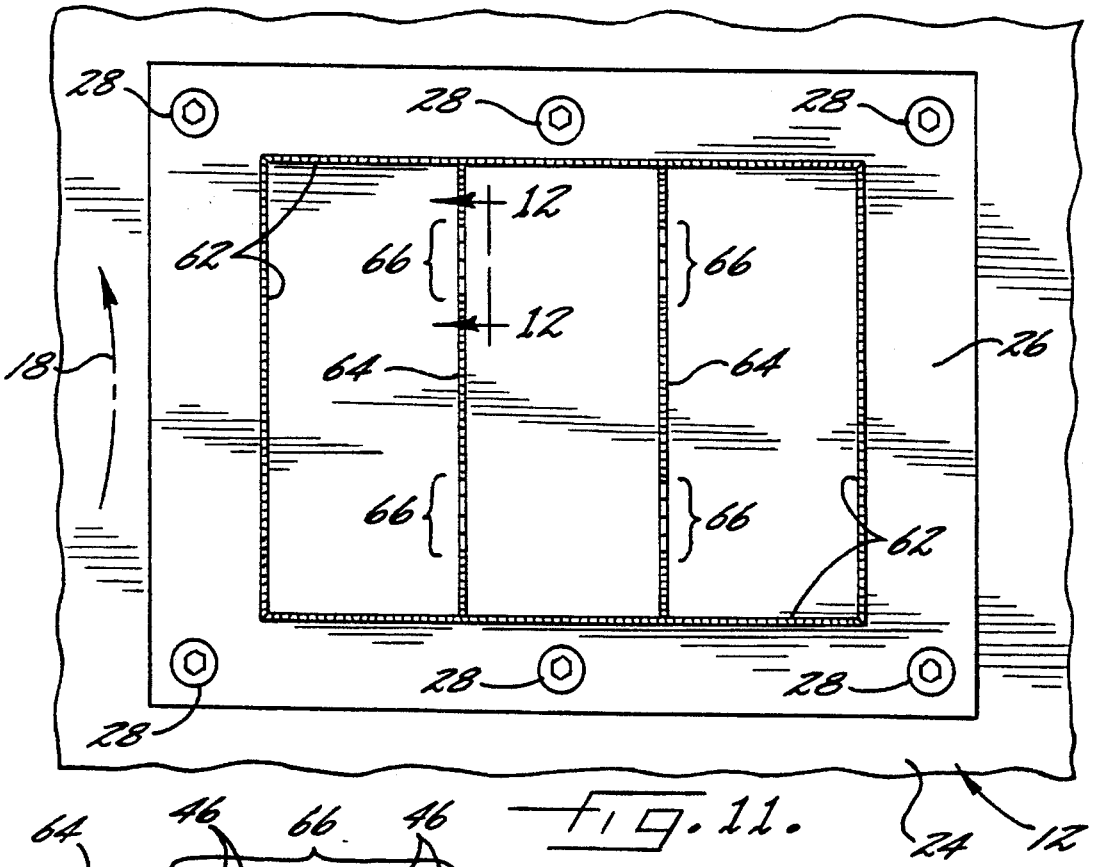
FIG. 11 is a flattened plan view of another embodiment wherein the die members upon the die board of the die apparatus are adapted to form a paperboard sheet into three adjacent panels joined together by frangible nicking connectors in accordance with the invention.
Figure 12:
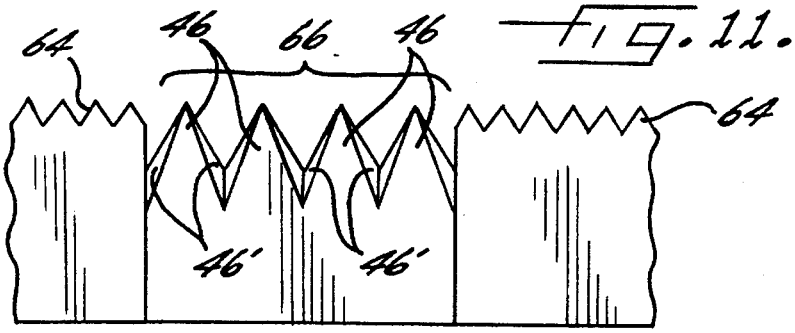
FIG. 12 is a fragmentary elevational view, taken in the direction of the arrows 12—12 of FIG. 11, of a perforating rule for forming one of the nicking connectors, parts of the cutting rule adjacent the perforating rule also being shown.
Figure 13:
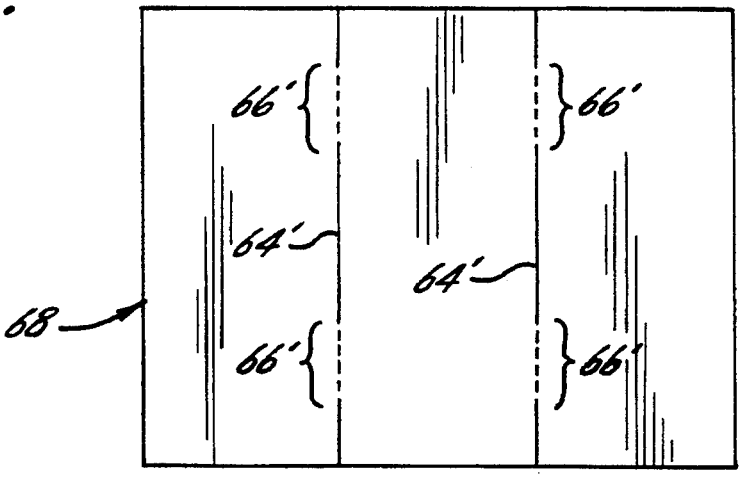
FIG. 13 is a top plan view of a paperboard sheet having nicking connectors formed by the apparatus of FIG. 11.

FIG. 11 of the drawings shows a die assembly upon die board 26 that is adapted to form, from a conventional sheet of paperboard material (not shown), a panel having three laterally adjacent sections that are interconnected by "nicking" connectors. The die assembly includes conventional toothed peripheral cutting rules 62 and interior rules 64 that may be and illustratively are of the same construction as rule 62 except for their having, at spaced locations along their length, means 66 for forming nicking connections between multiple like things such as the three adjacent panels 68 of the paperboard sheet shown in FIG. 13. As is well known to those skilled in the art, a nicking connection in a cutting rule member is usually formed by providing a slot that is disposed within and that opens from the outer edge portion of the rule member. This frequently does not produce a nicking connection that separates in the desired manner. In accordance with the present invention, the improved means 66 for forming nicking connections that readily separate consists of sharpened pointed teeth that may be and preferably are of the same type as the teeth 46 shown in FIGS. 5 and 6 of the drawings. The teeth 46 project outwardly from the cutting rules 64 with which they are associated and form slits 66' (FIG. 13) at those locations in a panel 68 where nicking connections are desired. The length of the slits 66' can be readily adjusted, in any of the ways previously noted, so as to cause the nicking connections to perform their desired function of maintaining the panel sections together during their passage through the anvil and die rolls of the apparatus, while permitting neat and easy separation of the panel sections from each other following their passage through such rolls.

Figure 14:
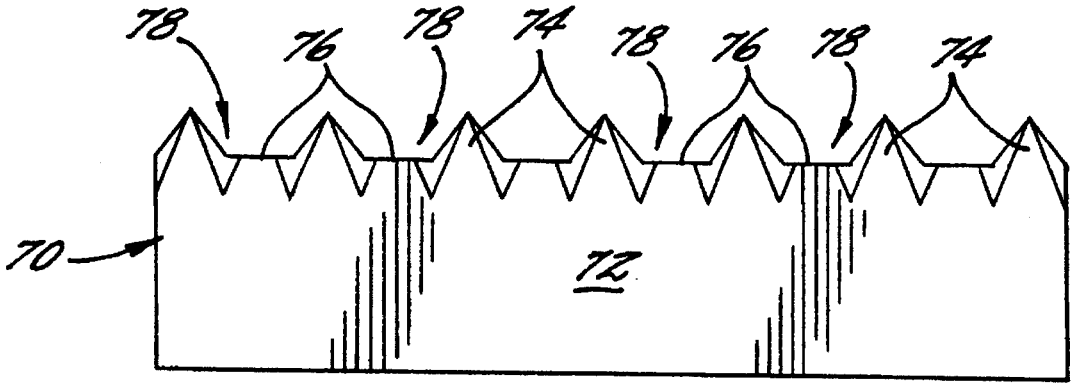
FIG. 14 is an elevational view of a straight slit scoring and creasing rule in accordance with the invention.
Figure 15:
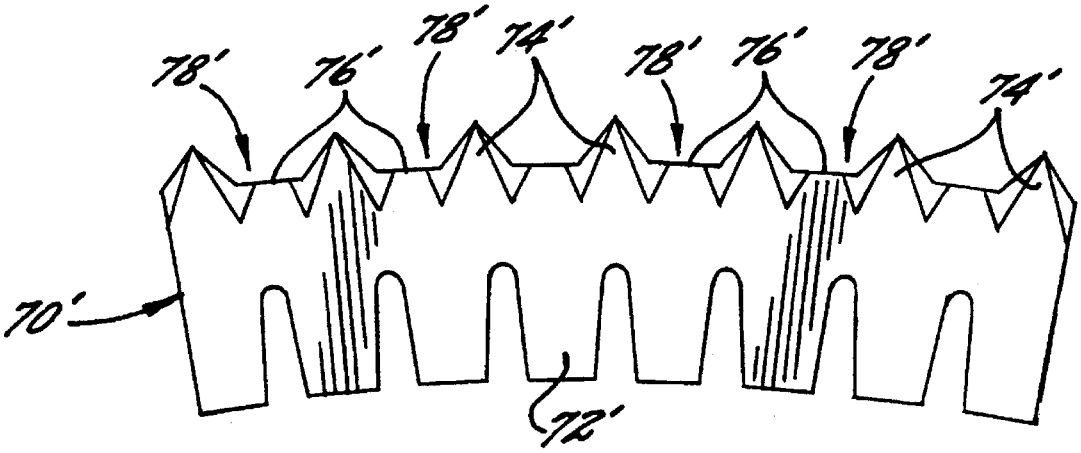
FIG. 15 is a view similar to FIG. 14 of a curved slit scoring and creasing rule.
Figure 16:
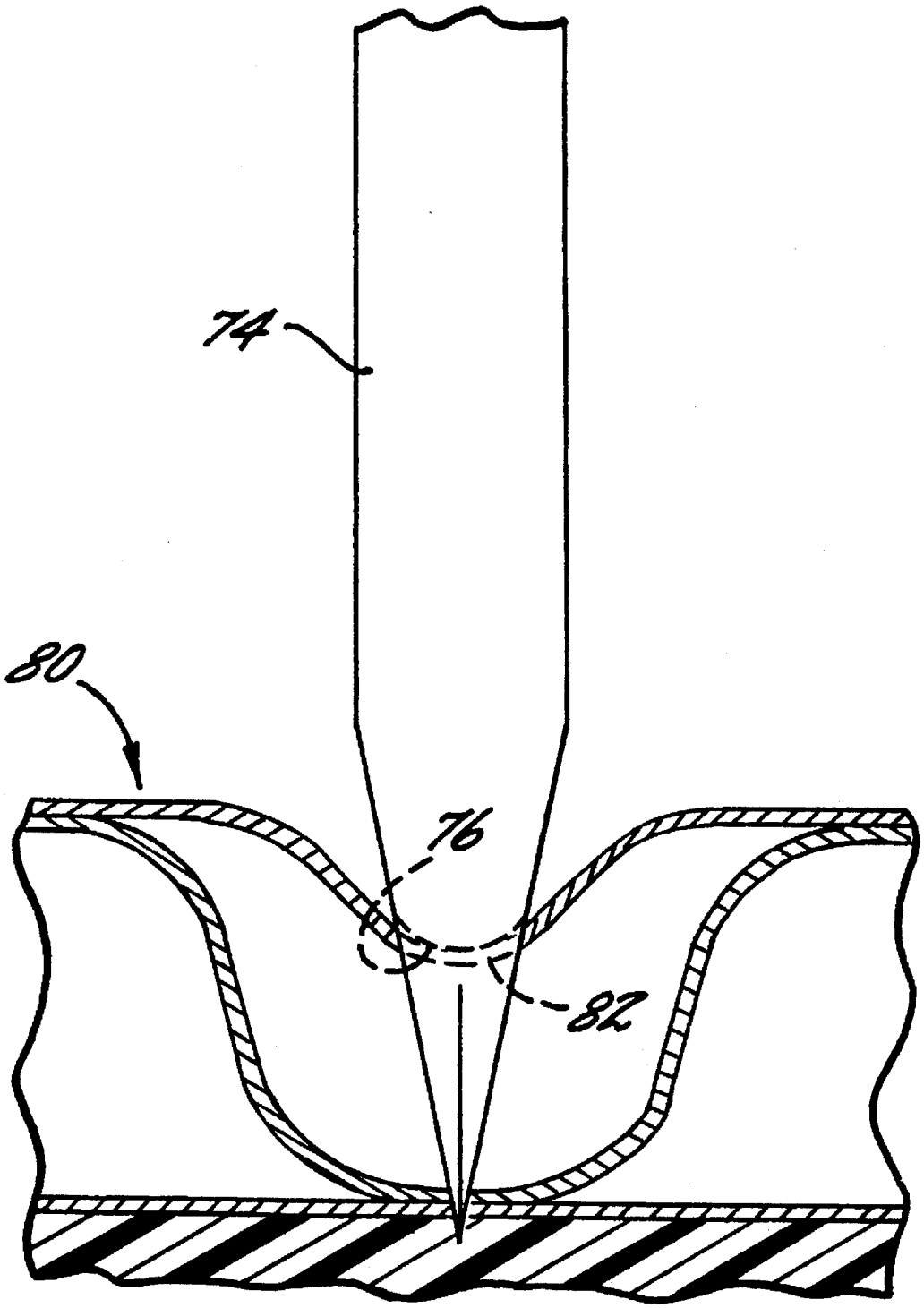
FIG. 16 is a side view of a slit scoring and creasing rule shaping a paperboard sheet.

FIGS. 14 and 15 show combination slit-scoring and creasing rules that are of substantially the same construction except for the rule 70 of FIG. 14 being straight and the rule 70' of FIG. 15 being curved. The numerals used in the following description of components of the rule 70 are therefore also used, with the addition of a prime designation, to identify corresponding components of rule 70'. Rule 70 has a body 72 whose inner (lower, as viewed in FIG. 14) edge portion is secured in a conventional manner to, and projects outwardly from, the die roll (not shown in FIG. 14) of the rotary die apparatus. A plurality of sharp, tapered, pointed teeth 74, which are similar to or the same as the previously described teeth project outwardly from the outer (upper, as viewed in FIG. 14) edge 76 of the rule. At least some (and illustratively all) laterally adjacent ones of the teeth 74 are separated from each other by intervening spaces 78. The sections of rule outer edge 76 within spaces 78 are free from sharp edges and the like, and preferably have smooth and rounded outer surfaces. Referring now also to FIG. 16 of the drawings, during use of rule 72 its teeth 74 slit score a paperboard sheet 80 in the same manner as previously described with respect to teeth 46. Additionally, and substantially simultaneously, the sections of outer edge 76 within space 78 engage and form aligned creases 82 (only one of which is shown in FIG. 16) within the inner (upper, as shown in FIG. 16) part of the sheet. The slits formed in sheet S0 are generally parallel to, and alternate with the creases 82, and line in a common vertical (as viewed in FIG. 16) plane. The slits significantly decrease the possibility of "wandering" of the creases, even when they extend parallel to the flutes of sheet 80.

Another embodiment of the present invention is illustrated in FIGS. 17–21. This embodiment is a modification of the die rule embodiment illustrated in FIGS. 14–16, which creates in the paperboard inner ply (the ply nearest the die roll that contacts the die rule during processing of the paperboard) a series of aligned alternating slits and creases. In the embodiment of FIGS. 17–21, the die rule and teeth are configured so that a series of aligned alternating slits and creases is created in the paperboard inner ply and a series of discontinuous aligned slits is created in the paperboard outer ply (the ply nearest the anvil roll). The slits created in the outer ply are illustratively and preferably of substantially the same size as the slits of the inner ply, thus creating a perforated and scored paperboard product similar to that created by flat die methods.

In describing herein the embodiment of FIGS. 17–21, the following terms are used to explain the positional relationship of structures on the die roll, die board and die rule to one another. The illustrated die rule is adapted to be mounted circumferentially to a die board which is then mounted on a die roll having an axis of rotation. As used herein, the terms "forward" and "front" and derivatives thereof refer to the direction parallel with the die roll axis of rotation and extending out of the page in FIG. 18. Conversely, the term "rear" and derivatives thereof refer to the direction that is directly opposite the forward direction; i.e., the direction parallel with the axis of rotation and extending into the page in FIG. 18. The term "lateral" refers to the direction extending perpendicular to the axis of rotation and parallel to the direction of travel of paperboard through the nip defined by the die and anvil rolls. The term "leading" refers to the lateral direction extending with the direction of paperboard travel; the term "lagging" refers to the lateral direction extending opposite the direction of paperboard travel. The term "radial" refers to the direction defined by vectors originating at the die roll axis of rotation. The term "radially inward" and derivatives thereof refer to the radial direction extending toward the axis of rotation; the term "radially outward" and derivatives thereof refer to the radial direction extending away from the axis of rotation.

Figure 17:
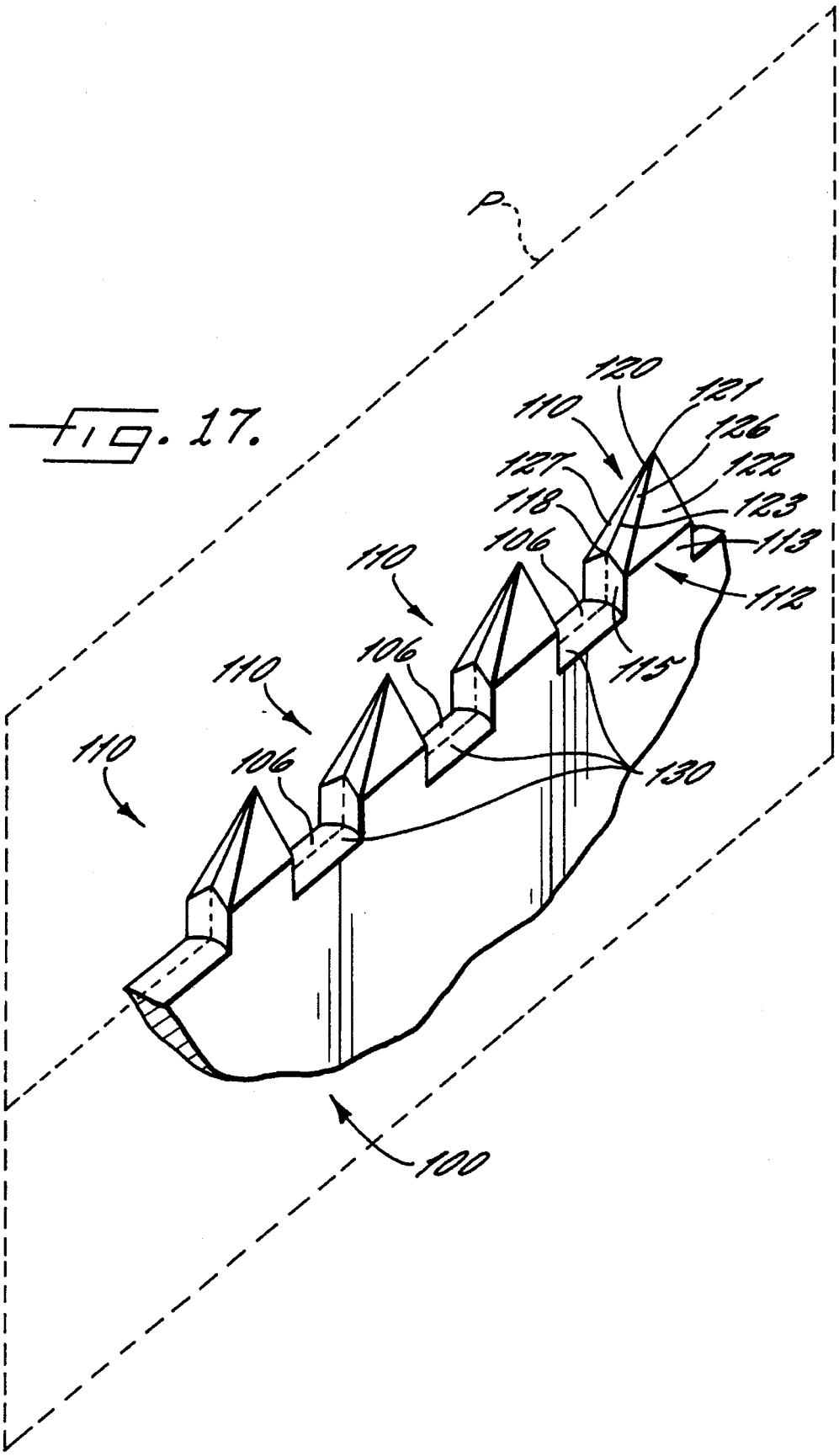
FIG. 17 is a perspective view of a die rule embodiment useful for perforating and creasing a paperboard sheet.
Figure 18A:
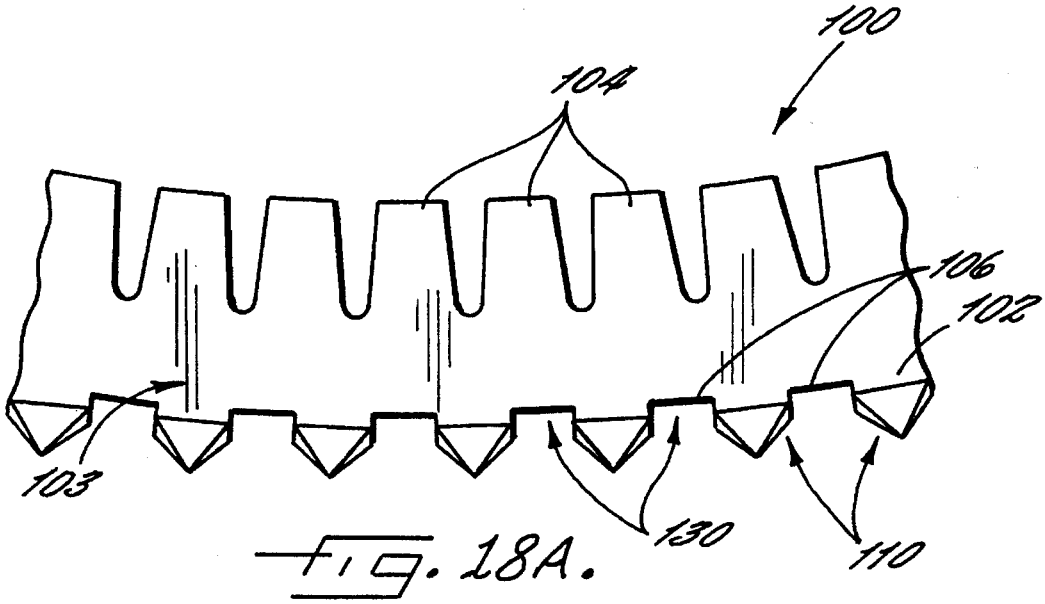
FIG. 18 is an elevational view of the die rule of FIG. 17.
Figure 18B:
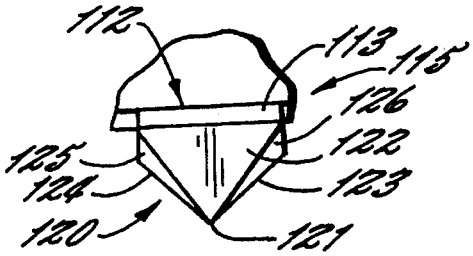

Referring now to the drawings, FIGS. 17 and 18 show a perforating-creasing die rule 100 of the present invention. The rule 100 comprises a base 102, which is configured to mount to and extend radially from a die board mounted to a die roll, and a plurality of tooth elements 110 which are separated from one another by open spaces 130. Although only a limited number of tooth elements 110 (four in FIG. 17, three in each of FIGS. 18 and 19) are illustrated herein, those skilled in this art will understand that any number of tooth elements can be used with the present invention.

The base 102 comprises a planar plate having a front surface 103 and an opposed parallel rear surface (not shown). The base 102 has a generally arcuate profile (best seen in FIGS. 18 and 19) that is concentric with the cylindrical surface of the die board to which it is mounted. With this profile, the rule 100 will be mounted in a plane normal to the die roll axis of rotation. The rule 100 so mounted will form perforations and creases in a paperboard sheet that are parallel to the direction of travel of the paperboard. Those skilled in this art will understand that this invention is also suitable for forming perforations that are perpendicular to the paperboard travel direction, in which case the base 102 would be straight rather than arcuate, and the rule 100 would be mounted in a plane parallel to the die roll axis of rotations, and perforations that are oblique to the travel direction, in which case the base 102 would take a shallower arcuate profile than that illustrated, and the rule 100 would be mounted in a plane that is oblique to the die roll axis of rotation.

The base 102 includes prongs 104 (FIG. 18) that project radially inwardly to anchor the base 102 to a die board so that the base 102 extends radially outward therefrom. Those skilled in this art will appreciate that, although prongs 104 are preferred, any means that attaches the rule 100 to the die board and the die roll so that the rule 100 remains stationary relative to the die board and the die roll during rotation thereof is suitable for use with the present invention. The base 102 also includes an outer edge 106. The outer edge 106 is blunt and of a depth (as measured from the base front surface 103 and the base rear surface) that can form a crease in a paperboard sheet when contacted thereto; the outer edge depth is typically between about 0.75 and 1.25 inches.

Each tooth element 110 extends radially outwardly from the outer edge 106 of the base 102. It will be understood by those skilled in this art that each tooth element of die rules of the present invention is substantially identical to the others; accordingly, in the interest of brevity and clarity, only one exemplary tooth element will be described herein, with the understanding that the discussion is equally applicable to the remaining tooth elements also. In addition, each tooth element is symmetrical about a plane of symmetry P (illustrated schematically in FIG. 17) that extends through the depth of each tooth element 110 and the base 102 equidistant from the base front surface 103 and the base rear surface.

Each tooth element 110 (best seen in FIG. 17 and the inset to FIG. 18) comprises a body portion 112 and a laterally-tapered tooth portion 120. The body portion comprises a front face 113, a parallel opposed rear face (not shown), and a pair of lateral faces: a lagging face 115 and a leading face (not shown) opposed to the lagging face 115. The front face 113 is fixed to and is coplanar and merges with the base front surface 103 at the base outer edge 106; the body portion rear face is similarly positioned and oriented relative to the base rear surface. Each of the lagging face 115 and the leading face is illustratively and preferably substantially perpendicular to the body portion front face 113, the body portion rear face, and the adjacent base outer edge portion 106. The lagging face 115 is substantially pentagonal, with the base of the pentagon being formed by a portion of the base outer edge 106, the lower sides being formed by the lagging edges of the body portion front face 113 and the rear face, and the top sides of the pentagon originating at the radially outermost portions of the lagging edges of the front and rear faces and extending therefrom radially outwardly and toward the plane of symmetry P to form a vertex 118.

The body portion 112 extends radially outwardly from the outer edge 106 so that substantially all of the laterally-tapered tooth portion 120 of the tooth element 110 can penetrate both the inner and outer plies of a sheet of paperboard. Preferably, the body portion 112 extends radially outwardly between about 0.025 and 0.1 inches from the base outer edge 106. Laterally, the body portion 112 is sized to match the desired length of the slits to be formed in the paperboard, which are typically between about 0.1 and 0.75 inches, with 0.125, 0.25, 0.375, and 0.5 inches being commonly used lengths.

The laterally tapered tooth portion 120 of the tooth element 110 comprises six different triangular bezels: front and rear lagging edge bezels 126, 127; a front bezel 122 and an opposed rear bezel (not shown); a front leading edge bezel 125; and a rear leading edge bezel (not shown). As used herein, "laterally tapered" means that the tooth portion has a sharp point 121 at its radially outermost position and recedes radially inwardly therefrom so that its lateralmost portions are radially inward of the sharp point 121. The front bezel 122 originates at the outer edge of the body portion front face 113 and, as it narrows, extends radially outwardly and toward the plane of symmetry P until it terminates at the sharp point 121. Similarly, the rear bezel originates at the outer edge of the body portion rear face and narrows and extends radially outwardly and toward the plane of symmetry P until it terminates at the sharp point 121. The taper of the tooth portion 120 in the depth dimension (formed by the mutual termination of the front bezel 122 and the rear bezel at the sharp point 121) is preferred, as it facilitates entry of the tooth portion 120 into the paperboard. The front lagging edge bezel 126 originates at the front top edge of the body portion lagging face 115 and extends therefrom to the sharp point 121. The rear lagging edge bezel originates at the rear top edge of the body portion lagging face 115 and extends therefrom to the sharp point 121. The front and rear lagging edge bezels 126, 127 meet and merge at the plane of symmetry P to form a lagging cutting edge 123 that extends from the lagging face vertex 118 to the sharp point 121. Similarly, the front leading edge bezel 125 originates at the front top edge of the body portion leading face and extends to the sharp point 121, and the rear leading edge bezel originates at the rear top edge of the body portion leading face and extends to the sharp point 121. The leading cutting edge 124 is formed by the junction between the front leading edge bezel 125 and the rear leading edge bezel.

Those skilled in this art will appreciate that, although for manufacturing reasons the illustrated interrelated sextet of bezels is preferred, the tooth portion 120 of the tooth element 110 can take any configuration in which the tooth portion 120 has a sharp point and is laterally tapered. Exemplary alternative configurations include, among others, those in which the tooth portion is an elongated sharpened cone and those which include additional front and rear bezels. It is preferred that the tooth portion include leading and lagging cutting edges, as these facilitate penetration of the tooth portion into the paperboard and passage therethrough.

The dimensions of the tooth portion 120 can vary with the desired slit length. The base of the tooth portion 120 should match the lateral width and depth of the body portion 112. The sharp point 121 typically extends between about 0.050 to 0.25 inches radially outward of the body portion 112, with between about 0.125 and 0.175 inches being preferred.

The tooth elements 110 are separated by open spaces 130 (FIGS. 17 and 18), each of which is defined by the body portion leading face of one tooth element, the lagging face 115 of the adjacent tooth element, and the base outer edge 106 extending therebetween. The outer edge 106 is blunt and slightly rounded to form a crease in the die surface of paperboard without slitting it. Generally, the open spaces 130 are approximately the same length as the adjacent tooth elements 110, although those skilled in this art will understand that this length can vary considerably and still be suitable for use with this invention.

Figure 19:
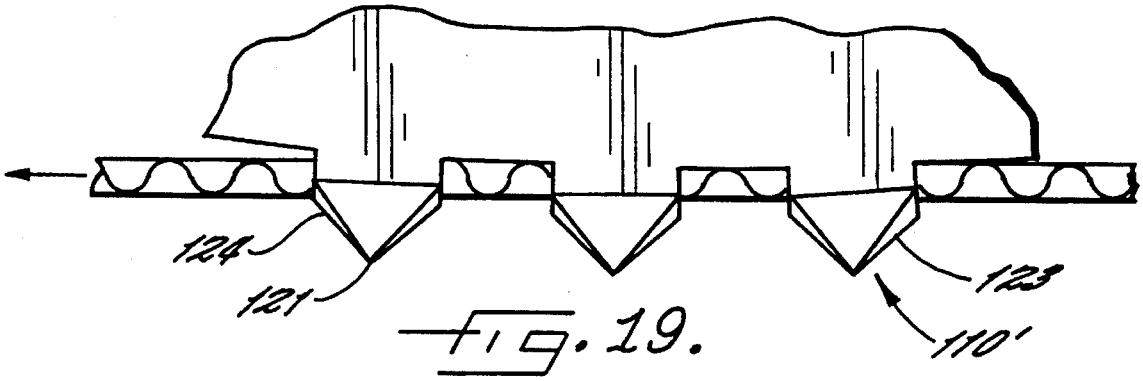
FIG. 19 is an elevational view illustrating the perforation and creasing of a paperboard sheet by the die rule of FIG. 17.

Use of the die rule 100 is illustrated in FIG. 19. A paperboard sheet travels through the nip between opposed die and anvil rolls (similar to those illustrated in FIG. 1) as they rotate in opposite directions. If the paperboard is corrugated, it is preferably oriented so that the "flutes" of the corrugated ply are oriented to be parallel with the direction of travel. The sharp point 121 of each tooth element 120 contacts and penetrates the paperboard inner ply. As the die roll continues to rotate and the paperboard continues to travel through the nip, the leading and lagging cutting edges 124, 123 form slits in the inner ply, the corrugated ply, and the outer ply of the paperboard. The position of the center tooth element of FIG. 19 (labelled 110') represents the deepest penetration of each tooth element into the paperboard. It can be observed that in this position, the large majority of the tooth portion 120 of the tooth element 110' has penetrated the outer ply, including the entirety of the leading and lagging cutting edges 124, 123. It should also be observed that, due to the leading and lagging faces of the body portion 112 being substantially perpendicular to the base outer edge 106 and thereby rendering the body portion 112 substantially the same width as the tooth portion 120, the slit formed in the paperboard inner ply is of substantially the same length as those formed in the paperboard outer ply. Further, it can be seen in FIG. 19 that the outer edge 106 contacts the inner ply and compresses the paperboard with sufficient pressure to form a crease therein. As the die rule 100 continues to rotate with the die roll and the paperboard continues to travel through the nip, the tooth element 110' is drawn away from the traveling paperboard; because the tooth portion 120 of the tooth element 110' is laterally tapered, the paperboard releases from the tooth element 110' without further increasing the size of the slit in the inner ply.

Figure 20:
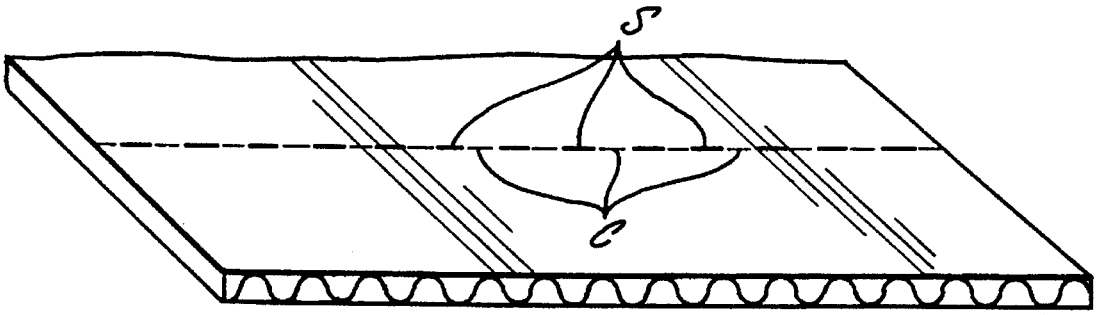
FIG. 20 is a perspective view of the inner ply of a paperboard sheet showing perforations and creases formed therein by the die rule of FIGS. 17–19.
Figure 21:
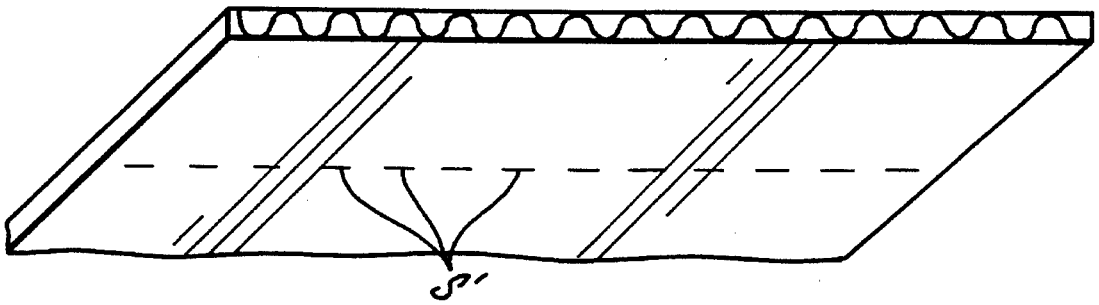
FIG. 21 is a perspective view of the outer ply of the paperboard sheet of FIG. 20 showing the perforations formed therein by the die rule of FIGS. 17–19 substantially simultaneously with the formation of perforations and creases illustrated in FIG. 20.

The paperboard sheet formed by the rule of FIGS. 17–19 is shown in FIGS. 20 and 21. The inner ply is illustrated in FIG. 20. The slits S formed therein alternate and serially align with the creases C. The opposing outer ply of the paperboard is shown in FIG. 21. The slits S' formed therein are of substantially the same length as slits S of the inner ply. The pattern of perforations and creases in the paperboard encourages the paperboard to fold along this line so that the portions of the inner ply on either side of the perforation-crease line tend to face one another.

The die rule 100 can be used with any variety of corrugated paperboard, including single wall (two plies surrounding a corrugated ply), double-wall (a construction comprising a first flat ply, a first corrugated ply, a second flat ply, a second corrugated ply, and a third flat ply), and the like. The thickness of the paperboard is not critical, as the dimensions of the tooth can be adapted to accommodate any sheet thickness.

Those skilled in this art will understand that the die rule can be used by itself or in conjunction with other types of rotary die rules, such as those described for the embodiments illustrated in FIGS. 1–16. Other rules may be contiguous or discontiguous with the rules of the present invention depending upon what types of frangible features are desired.

The foregoing embodiment is illustrative of the present invention, and is not to be construed as limiting thereof. The invention is defined by the following claims, with equivalents of the claims to be included therein.

That which is claimed is:

1. A rotary die apparatus for perforating and creasing a paperboard sheet which has opposing inner and outer surfaces, said apparatus comprising:

a die roll and an anvil roll extending in parallel relationship to each other and defining a nip therebetween through which the paperboard sheet passes, wherein the paperboard sheet inner layer contacts said die roll and the paperboard sheet outer layer contacts said anvil roll during passage of the paperboard;

drive means for rotating said rolls in opposite directions;

a die board mounted on said die roll for rotation therewith; and at least one die rule mounted on said die board comprising:

a base attached to and extending radially outwardly from said die roll having an outer edge;

a plurality of tooth elements, each of which comprises a body portion fixed to said base outer edge and extending radially outwardly therefrom, said body portion having a pair of opposed lateral portions, and a sharp laterally-tapered tooth portion attached to and extending radially outward from said body portion;

wherein each of said tooth elements have therebetween open spaces, each of which is defined by said lateral portions of adjacent tooth element body portions and a blunt portion of said base outer edge extending therebetween, the distance between each pair of body portion lateral portions of each tooth element being less than or substantially the same as the distance between adjacent body portion lateral portions of adjacent tooth elements that define open spaces, and wherein said base outer edge is positioned radially outwardly from said die roll so that said blunt portions of said base outer edge in the open spaces engage and crease the inner surface of the paperboard.

2. The apparatus of claim 1, wherein each of said plurality of tooth element body portions extends radially outwardly so that substantially all of said tooth portion penetrates the outer surface of the paperboard.

3. The apparatus of claim 1 wherein each of said tooth portions of said plurality of tooth elements is tapered in the depth dimension.

4. The apparatus of claim 1, wherein each of said plurality of tooth elements has one of said open spaces therebetween.

5. The apparatus of claim 4, wherein each of said body portion lateral portions is substantially perpendicular to said base outer edge portion in adjacent open spaces.

6. The apparatus of claim 1, wherein said die rule base is mounted on said die board to be substantially parallel with the direction of travel of the paperboard through said nip.

7. A die for perforating and creasing a paperboard sheet which has opposing inner and outer surfaces, said die comprising:

a die board configured to be mounted to a die roll which is mounted in parallel relationship to an anvil roll and defining a nip therebetween, wherein the paperboard sheet inner layer contacts said die roll and the paperboard sheet outer layer contacts said anvil roll during passage of the paperboard through the nips said die board having opposed inner and outer surfaces, and at least one die rule mounted on said die board outer surface, said die rule comprising:

a base attached to and extending radially outwardly from said die roll having an outer edge;

a plurality of tooth elements, each of which comprises a body portion fixed to said base outer edge and extending radially outwardly therefrom, said body portion having a pair of opposed lateral portions, and a sharp laterally-tapered tooth portion attached to and extending radially outwardly from said body portion; wherein each of said tooth elements having therebetween open spaces, each of which is defined by said lateral portions of adjacent tooth element body portions and a blunt portion of said base outer edge extending therebetween, distance between each pair of body portion lateral portions of each tooth element being less than or substantially the same as the distance between said adjacent body portion lateral portions of adjacent tooth elements that define open spaces, and wherein said base outer edge extends radially outwardly from said die roll so that said blunt portions of said base outer edge in the open spaces engage and crease the inner surface of the paperboard.

8. The apparatus of claim 7, wherein each of said plurality of tooth element body portions extends radially outwardly so that substantially all of said tooth portion penetrates the outer surface of the paperboard.

9. The apparatus of claim 7, wherein each of said tooth portions of said plurality of tooth elements is tapered in the depth dimension.

10. The apparatus of claim 7, wherein each of said plurality of tooth elements has one of said open spaces therebetween.

11. The apparatus of claim 10, wherein each of said body portion lateral portions, is substantially perpendicular to said base outer edge in adjacent open spaces.

12. The apparatus of claim 7, wherein said die rule base is mounted on said die board to be substantially parallel with the direction of travel of the paperboard through said nip.

13. A method of perforating and creasing sheets of paperboard comprising the steps of:

passing a paperboard sheet having opposed inner and outer surfaces through the nip defined by opposed and parallel die and anvil rolls, wherein the paperboard inner surface contacts the die roll and the paperboard outer surface contacts the anvil roll; and contacting the paperboard with a die rule attached to the die roll comprising:

a base attached to and extending radially outwardly from said die roll having an outer edge;

a plurality of tooth elements, each of which comprises a body portion fixed to said base outer edge and extending radially outward therefrom, said body portion having a pair of opposed lateral portions and a laterally-tapered tooth portion attached to said body portion;

wherein at least some of said tooth elements have therebetween open spaces, each of which is defined by said lateral portions of adjacent tooth element body portions and a blunt portion of said base outer edge extending therebetween;

wherein each of said tooth element body portions extends radially outwardly so that substantially all of said tooth portion penetrates the outer surface of the paperboard and forms perforations in said inner and outer surfaces of said paperboard, and wherein said base outer edge extends radially outwardly from said die roll so that said blunt portions of said base outer edge in the open spaces engage and crease the inner surface of the paperboard.

14. A method according to claim 13, wherein said passing step comprising passing a sheet of corrugated paperboard through the nip between the anvil and die rolls, the corrugated paperboard comprising a corrugated layer between an inner ply having said inner surface and an outer ply having said outer surface.

15. A method according to claim 13, wherein said passing step comprises passing said paperboard through said nip so that said die rule forms perforations and creases in said paperboard inner surface that are substantially parallel with the direction of travel of said paperboard through said nip.

16. A method according to claim 13, wherein said contacting step comprises contacting said paperboard with a die rule having one of said plurality of open spaces between each of said tooth elements, so that a series of aligned and alternating perforations and creases are formed in said paperboard inner surface.

17. A method according to claim 16, wherein said contacting step further comprises contacting said paperboard with a die rule for which each of said lateral portions is substantially perpendicular to the inner surface of the paperboard during passage of the paperboard through said nip, so that the rule forms perforations in the paperboard outer surface that are substantially equal in length to the perforations formed in the paperboard inner surface.

* * * * *